United States Patent [19]

Maier et al.

[11] 4,036,162

[45] July 19, 1977

[54] MARINE PROPULSION DEVICE HAVING INCREASED REVERSE THRUST

[75] Inventors: Daniel F. Maier, Lake Villa; John D. Sheldon, Zion, both of Ill.

[73] Assignee: Outboard Marine Corporation, Waukegan, Ill.

[21] Appl. No.: 685,297

[22] Filed: May 11, 1976

[51] Int. Cl.[2] ..... B63H 5/13

[52] U.S. Cl. ..... 115/17; 115/73

[58] Field of Search ..... 115/12 A, 17, 18 R, 115/34 R, 35; 60/310, 312, 313, 314

[56] References Cited

U.S. PATENT DOCUMENTS

| | | | |
|---|---|---|---|
| 3,045,423 | 7/1962 | Hulsebus | 115/17 |
| 3,198,162 | 8/1965 | Larsen | 115/17 |
| 3,310,022 | 3/1967 | Kollman | 115/17 |
| 3,745,964 | 7/1973 | Henrich | 115/17 |
| 3,911,852 | 10/1975 | Miller et al. | 115/17 |

*Primary Examiner*—George E. A. Halvosa

*Assistant Examiner*—Jesus D. Sotelo

*Attorney, Agent, or Firm*—Michael, Best & Friedrich

[57] ABSTRACT

Disclosed herein is a marine propulsion device which comprises an engine having an exhaust port for discharging exhaust gas, and which also comprises a lower unit having an exhaust tube in communication with the exhaust port. The lower unit includes a cavitation plate submerged in water during idle engine operation, and an exhaust outlet in communication with the exhaust tube. The exhaust outlet affords discharge of the exhaust gas below the cavitation plate. The lower unit includes an outer wall including an outlet, which outer wall outlet is located above the cavitation plate and submerged in water during idle engine operation. The lower unit also incudes a passage in communication with the exhaust tube and the outer wall outlet. The passage affords, during reverse engine operation, discharge of a portion of the exhaust gas from the exhaust tube out the outer wall outlet.

14 Claims, 3 Drawing Figures

MARINE PROPULSION DEVICE HAVING INCREASED REVERSE THRUST

BACKGROUND OF THE INVENTION

The invention relates generally to marine propulsion devices such as outboard motors and stern drive units. More specifically, the invention relates to a marine propulsion device having a lower unit with a propeller located below a cavitation plate, which lower unit includes an exhaust outlet for discharging exhaust gas below the cavitation plate. Prior marine propulsiondevices are disclosed in Larsen U.S. Pat. No. 3,198,162, issued Aug. 3,1965; Boda U.S. Pat. No. 3,350,879, issued Nov. 7, 1967; and Irgens U.S. Pat. No. 3,249,083, issued May 3, 1966.

SUMMARY OF THE INVENTION

In general, the invention disclosed herein provides a marine propulsion device which develops relatively greater reverse thrust during reverse engine operation.

More specifically, the invention provides a marine propulsion device comprising an engine having an exhaust port for discharging exhaust gas and also comprising a lower unit having wall means defining an exhaust passage in communication with the exhaust port. The lower unit includes a cavitation plate submerged in water during idle engine operation, and also includes an exhaust outlet in communication with the exhaust passage. The exhaust outlet affords discharge of the exhaust gas below the cavitation plate. The lower unit also includes an outer wall having an outlet, which outer wall outlet is located above the cavitation plate and submerged in water during idle engine operation. The lower unit further includes passage means in communication with the exhaust passage and the outer wall outlet. The passage means affords, during reverse engine operation, discharge of a portion of exhaust gas from the exhaust passage out the outer wall outlet.

Also in accordance with an embodiment of the invention, there is provided a marine propulsion device wherein the lower unit includes an inner wall partially defining a chamber communicating with the outer wall outlet. The inner wall is located between the outer wall and the exhaust passage. The passage means comprises a reverse relief outlet extending through the inner wall.

Also in accordance with an embodiment of the invention, there is provided a marine propulsion device wherein the inner wall includes an end portion partially defining a lower portion of the chamber, which lower portion of the chamber is filled with water during engine operation. The reverse relief outlet is located in the inner wall end portion so that the pressure head of the water in the lower chamber acting on the reverse relief outlet, during idle and forward engine operation, substantially prevents any portion of the exhaust gas from being discharged through the reverse relief outlet into the chamber and out the outer wall outlet.

Also in accordance with an embodiment of the invention, there is provided a marine propulsion device wherein the lower unit includes conduit means connected in communication with the reverse relief outlet for lowering the entrance to the reverse relief outlet with respect to the exhaust gas within the exhaust passage, which conduit means comprises a wall member connected to one of the wall means and the inner wall adjacent the reverse relief outlet.

Also in accordance with an embodiment of the invention, there is provided a marine propulsion device including a reverse locking mechanism which activates to allow the engine to tilt out of the water when the lower unit is subject, during forward engine operation, to a substantial impact with an object, and wherein the reverse relief outlet and the outer wall outlet are sized so that the reverse thrust developed during reverse engine operation does not activate the reverse locking mechanism.

Also in accordance with an embodiment of the invention there is provided a marine propulsion device wherein the lower unit includes a propeller with a hollow hub member having a first open end and a second open end. The first open end is connected in communication with the exhaust passage, and the second open end constitutes the exhaust outlet of the lower unit. The reverse relief outlet is located in the inner wall so that a vortex, produced by the propeller during forward engine operation, draws water from the chamber through the reverse relief outlet into the exhaust passage. The vortex drawn water cools the exhaust gas before discharge of the exhaust gas through the propeller hub member.

Also in accordance with an embodiment of the invention, there is provided a marine propulsion device wherein the wall means defining the exhaust passage comprises an exhaust tube, and wherein the inner wall and the outer wall partially define a water jacket extending around the exhaust tube. The water jacket is filled with water during engine operation. The inner wall includes an upper end which generally defines an upper limit for a water level within the water jacket, and the chamber comprises a dump water chamber which catches water overflowing the upper end from the water jacket.

Also in accordance with an embodiment of the invention, there is provided a marine propulsion device wherein the inner wall includes a first idle exhaust outlet located above the water jacket and in communication with the chamber, and wherein the outer wall includes a second idle exhaust outlet in communication with the chamber. The first idle exhaust outlet affords discharge of the exhaust gas from the exhaust passage into the chamber and out the second idle exhaust outlet during idle engine operation.

One of the principal features of the invention is the provision of a marine propulsion device having a lower unit with a cavitation plate located above a propeller and also having an exhaust passage in communication with an exhaust outlet which affords discharge of exhaust gas below the cavitation plate. The lower unit includes passages means communicating with the exhaust passage and also includes an outer wall having an outlet in communication with the passage means. The outer wall outlet affords discharge of a portion of the exhaust gas from the exhaust passage above the cavitation plate during reverse engine operation, and thus, a relatively greater reverse thrust is developed by the propeller during reverse engine operation.

Another of the principal features of the invention is the provision of a marine propulsion device wherein the lower unit includes an inner wall which partially defines a chamber in communication with the outer wall outlet. The inner wall includes an end portion which defines a lower portion of the chamber which is filled with water during engine operation. The passage means comprises a reverse relief outlet extending through the inner wall end portion in communication with the exhaust passage and the outer wall outlet. The reverse relief outlet is located so that the pressure head of the water in the lower chamber, during idle and forward engine operation, substantially prevents any portion of the exhaust gas from being discharged through the reverse relief outlet into the chamber and out the outer wall outlet.

Another of the principal features of the invention is the provision of a marine propulsion device wherein the propeller comprises a hollow hub member having a first open end and a second open end. The first open end communicates with the exhaust passage and the second open end constitutes the exhaust outlet of the lower unit. The reverse relief outlet is located in the inner wall so that a vortex, produced by the propeller during forward engine operation, draws water from the chamber through the reverse relief outlet into the exhaust passage, and thus the exhaust gas is cooled before being discharged through the propeller hub member exhuast outlet.

Other features and advantages of the embodiments of the invention will become known by reference to the following drawings, general description and claims.

DRAWINGS

Figure 1:
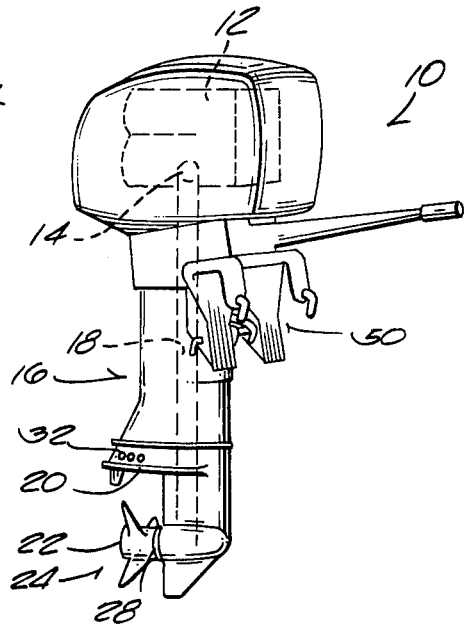
FIG. 1 is a perspective diagrammatic view of a marine propulsion device embodying various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device in the form of an outboard motor 10 comprising an engine 12 having an exhaust port 14 for discharging exhaust gas. The outboard motor 10 also comprises a lower unit 16 partially submerged in water during engine operation, which lower unit includes wall means defining an exhaust passage 18 in communication with the exhaust port 14.

The lower unit 16 includes a cavitation plate 20 submerged in water during idle engine operation, and also includes an exhaust outlet 22 in communication with the exhaust passage 18. The exhaust outlet 22 affords discharge of the exhaust gas below the cavitation plate 20.

Various exhaust outlet arrangements are possible, one such arrangement (not shown) comprises a snout-nosed exhaust outlet located adjacent the cavitation plate. In the preferred embodiment shown, the lower unit 16 includes a propeller 24 with a hollow hub member 26 having a first open end 28 communicating with the exhaust passage 18, and having a second open end which constitutes the exhaust outlet 22 of the lower unit.

The lower unit 16 includes an outer wall 30 having an outlet 32 (three shown) located above the cavitation plate 20. The outer wall outlet 32 is generally submerged in water during idle and low speed engine operation. The lower unit also includes passage means in communication with the exhaust passage 18 and the outer wall oulet 32. The passage means affords, during reverse engine operation, discharge of a portion of the exhaust gas from the exhaust passage 18 out the outer wall outlet 32, and thus, as will be described in more detail below, a relatively greater reverse thrust is developed by the propeller 24 during reverse engine operation.

The lower unit 16 preferably includes an inner wall 34 which is located between the outer wall 30 and the exhaust passage 18 and which partially defines a chamber 36 in communication with the outer wall outlet 32. The above described passage means, located in communication with the exhaust passage 18 and the outer wall outlet 32, preferably comprises a reverse relief outlet 38 extending from the exhaust passage 18 through the inner wall 34 to the chamber 36

In the preferred embodiment shown, the wall means which defines the exhaust passage 18 comprises an exhaust tube 40, which communicates with the exhaust port 14 of the engine 12. Portions of the inner wall 34 and the outer wall 30 partially define a water jacket 42 which extends around the exhaust tube 40. The water jacket 42 is filled with water during engine operation from the output of a conventional engine cooling system (not shown). The water in the water jacket 42 provides partial cooling of and muffles the sound of the exhaust gas flowing through the exhaust tube 40.

The inner wall 34 includes an upper end 44 which defines an upper limit for the water level within the water jacket 42. When the water delivered to the cooling jacket from the cooling system exceeds the upper limit, the water overflows the upper end 44 and is caught by the chamber 36, which chamber 36 preferably constitutes a dump water chamber.

When the outboard motor 10 is first operated, the exhaust passage 18 and the chamber 36 are filled with water to the ambient level of the water in which the lower unit 16 is partially submerged. (The ambient water level is shown diagrammatically at 39 in FIG. 2.) In order to vent the exhaust gas during idle and low speed engine operation, idle exhaust outlets are provided which are located above the ambient water level. More specifically, the exhaust tube 40 includes a first idle exhaust outlet 46 located above the water jacket 42 and in communication with the chamber 36. The outer wall 30 includes a second idle exhaust outlet 48 also in communication with the chamber 36.

The idle exhaust outlets 46 and 48 are sized to vent the normal amount of exhaust gas produced by the engine during idle and low speed engine operation. As the engine speed increases from idle, the amount and pressure of the exhaust gas within the exhaust passage 18 increases. Thus, the idle exhaust outlets are unable to vent all of the exhaust gas produced by the engine during higher speed engine operation.

In prior marine propulsion devices, during higher speed reverse engine operation, some of the exhaust gas has been forced to exit through the exhaust outlet below the cavitation plate. The exhaust gas discharged below the cavitation plate causes turbulence and ventilation of the water in the vicinity of the propeller, and hence causes a loss of reverse thrust.

In the invention disclosed herein, during higher speed reverse engine operation, a portion of the exhaust gas is discharged into the water above the cavitation plate. More specifically, a portion of the exhaust gas is discharged from the exhaust tube 40 through the reverse relief outlet 38 into the chamber 36 and out the outer wall outlet 32. Since the outer wall outlet 32 is located above the cavitation plate 20, the exhaust gas discharged through the outlet 32 generally does not cause turbulence or ventilation of the water in the vicinity of the propeller 24, and thus a relatively greater reverse thrust is developed by the propeller 24 during higher speed reverse engine operation.

As shown diagrammatically in FIG. 1, the outboard motor 10 is provided with a conventional reverse locking mechanism 50 which activates to allow the outboard motor 10 to tilt out of the water when the lower unit 16 is subject, during forward engine operation, to a substantial impact with an object. It is to be understood that the reverse relief outlet 38 and the outer wall outlet 32 are limited in size so that the relatively greater reverse thrust developed during higher speed reverse engine operation does not activate the reverse locking mechanism 50.

During higher speed forward engine operation, i.e., at engine speeds greater than about 1500 RPM, the propeller 24 produces a vortex which creates a negative pressure at the exhaust outlet 22. This negative pressure or vortex pulls water from within the chamber 36 through the reverse relief outlet 38 into the exhaust passage 18. The vortex drawn water cools the exhaust gas before flowing through the exhaust outlet 22 of the hollow hub member 26, and thus tends to prolong the life of the bearings and rubber members (not shown) which may be utilized in connection with the propeller hub member for safety purposes.

During lower speed forward engine operation, i.e., at engine speeds increasing up to about 1500 RPM, the exhaust gas is discharged under increasing pressure through the idle exhaust outlets 46 and 48. In order to prevent bubbling, or the escape of exhaust gas out the reverse relief outlet 38 and the outer wall outlet 32 during lower speed forward engine operation, the inner wall 34 preferably includes a lower end portion 52. The lower end portion 52 partially defines a lower portion 54 of the chamber 36, which lower portion 54 is filled with water during idle and lower speed forward engine operation. The reverse relief outlet 38 is preferably located low enough in the inner wall end portion 52 so that the pressure head or static head of the water in the lower portion 54 of the chamber 36, acting on the reverse relief outlet 38, substantially prevents any portion of the exhaust gas from being discharged from the exhaust passage 18 through the reverse relief outlet 38 into the chamber 36 and out the outer wall outlet 32.

Figure 3:
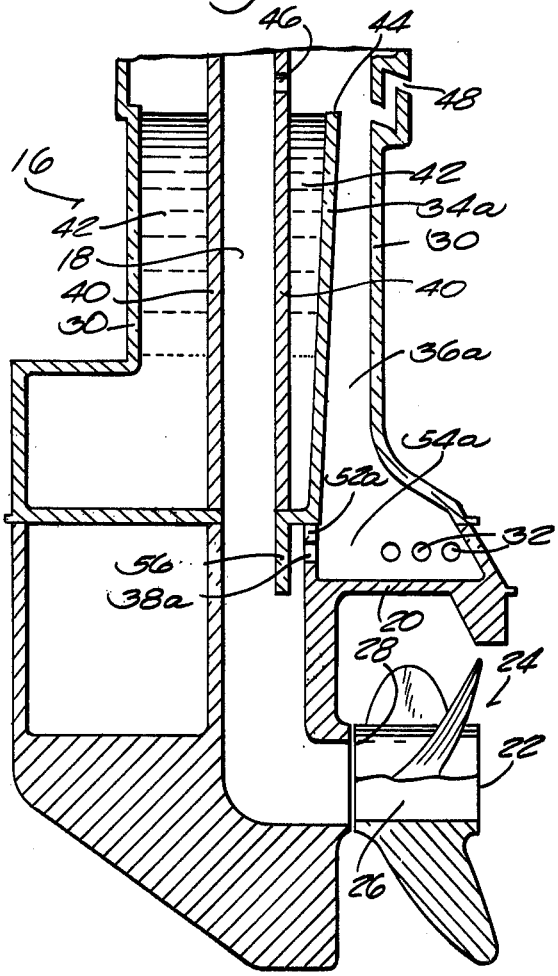
FIG. 3 is a view similar to FIG. 2 illustrating an alternative embodiment of the invention.

FIG. 3 illustrates an alternative embodiment of the invention wherein modified parts of the lower unit 16 are noted by the subscript *a.*

Figure 2:
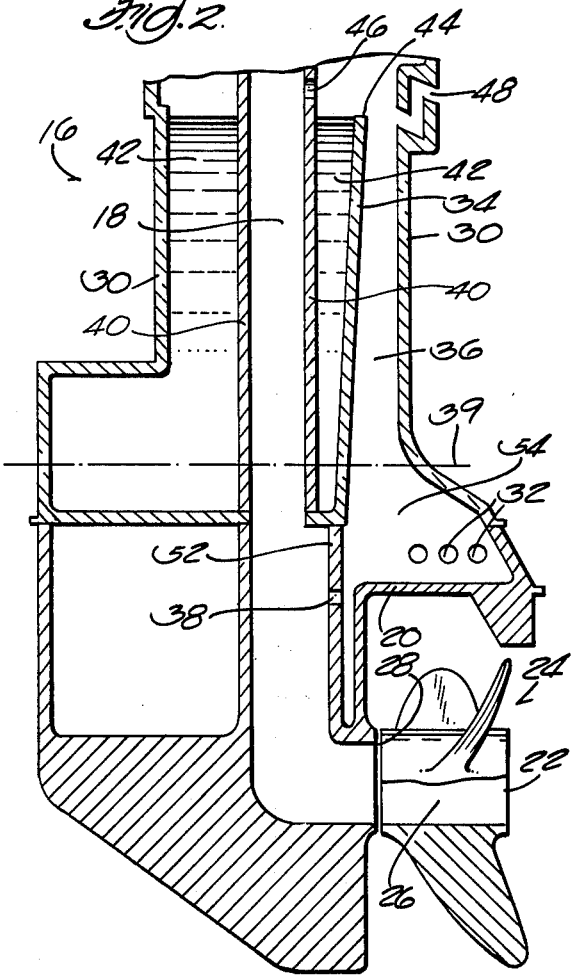
FIG. 2 is an enlarged partial side sectional view of the marine propulsion device shown in FIG. 1.

As shown in FIG. 3 the reverse relief outlet 38*a* extends through a relatively higher portion of the lower end portion 52*a* of the inner wall 34*a.* Also, the lower portion 54*a* of the chamber 36*a* does not extend downwardly as far as the lower portion 54 shown in the embodiment of the invention illustrated in FIG. 2. In order to maintain a pressure head or static head or water great enough to prevent bubbling during lower speed forward engine operation, conduit means are connected in communication with the reverse relief outlet 38*a* for lowering the entrance to the reverse relief outlet with respect to the exhaust gas within the exhaust passage 18.

While various arrangements are possible, preferably the conduit means comprises a wall member 56 connected to one of the wall means defining the exhaust passage 18 and the inner wall 34*a* adjacent the reverse relief outlet 38*a.* Specifically, the wall member 56 is connected to the lower end portion 52*a* of the inner wall 34*a.*

At forward engine speeds greater than about 1500 RPM, no bubbling will occur since, as noted above, the propeller produces a vortex which creates a negative pressure at the exhaust outlet 22. Thus, at forward engine speeds greater than about 1500 RPM generally all of the exhaust gas is discharged from the exhaust passage 18 through the exhaust outlet 22.

Various features of the invention are set forth in the following claims.

What is claimed is:

1. A marine propulsion device comprising an engine having an exhaust port for discharging exhaust gas, and also comprising a lower unit having wall means defining an exhaust passage in communication with said exhaust port, said lower unit also having a propeller, said lower unit also having a cavitation plate located above said propeller and submerged in water during idle engine operation, said lower unit also having an exhaust outlet in communication with said exhaust passage, said exhaust outlet affording discharge of the exhaust gas below said cavitation plate and aft of said propeller, said lower unit also having an outer wall including an outlet, said outer wall outlet being located above said cavitation plate and submerged in water during idle engine operation, said lower unit also having passage means in communication with said exhaust passage and said outer wall outlet, said passage means affording, during reverse engine operation, discharge of a portion of the exhaust gas from said exhaust passage out said outer wall outlet.

2. A marine propulsion device in accordance with claim 1 wherein said lower unit includes an inner wall partially defining a chamber communicating with said other wall outlet, said inner wall being located between said outer wall and said exhaust passage, and wherein said passage means comprises a reverse relief outlet extending through said inner wall.

3. A marine propulsion device in accordance with claim 2 wherein said inner wall includes an end portion partially defining a lower portion of said chamber, said lower portion of said chamber being filled with water during engine operation, and wherein said reverse relief outlet is located in said inner wall end portion so that the pressure head of the water in said lower chamber acting on said reverse relief outlet, during idle and forward engine operation, substantially prevents any portion of the exhaust gas from being discharged through said reverse relief outlet into said chamber and out said outer wall outlet.

4. A marine propulsion device in accordance with claim 3 wherein said lower unit includes conduit means connected in communication with said reverse relief outlet for lowering the entrance to said reverse relief outlet with respect to the exhaust gas within said exhaust passage.

5. A marine propulsion device in accordance with claim 4 wherein said conduit means comprises a wall member connected to one of said wall means and said inner wall adjacent said reverse relief outlet.

6. A marine propulsion device in accordance with claim 1 including a reverse locking mechanism which is releasable to allow said engine to tilt out of the water when said lower unit is subject, during forward engine operation, to a substantial impact with an object, and wherein said reverse relief outlet and said outer wall outlet are sized to limit reverse thrust developed during reverse engine operation so as not to release said reverse locking mechanism.

7. A marine propulsion device in accordance with claim 1 wherein said lower unit includes a propeller with a hollow hub member having a first open end and a second open end, said first open end being connected in communication with said exhaust passage, said second open end constituting said exhaust outlet of said lower unit.

8. A marine propulsion device in accordance with claim 7 wherein said propeller, during forward engine operation, produces a vortex, and wherein said reverse relief outlet is located in said inner wall so that said vortex draws water from said chamber through said reverse relief outlet into said exhaust passage, said vortex drawn water cooling the exhaust gas before discharge of the exhaust gas through said propeller hub member.

9. A marine propulsion device in accordance with claim 2 wherein said wall means defining said exhaust passage comprises an exhaust tube in communication with said exhaust port, and wherein said inner wall and said outer wall partially define a water jacket extending around said exhaust tube, said water jacket being filled with water during engine operation.

10. A marine propulsion device in accordance with claim 9 wherein said exhaust tube includes a first idle exhaust outlet located above said water jacket and in communication with said chamber, and wherein said outer wall includes a second idle exhaust outlet in communication with said chamber, said first idle exhaust outlet affording discharge of the exhaust gas from said exhaust passage into said chamber and out said second idle exhaust outlet during idle engine operation.

11. A marine propulsion device in accordance with claim 10 wherein said inner wall includes an upper end which generally defines an upper limit for a water level within said water jacket, and wherein said chamber constitutes a dump water chamber which catches water overflowing said upper end from said water jacket.

12. A marine propulsion device comprising an engine having an exhaust port for discharging exhaust gas, and also comprising a lower unit having an exhaust tube in communication with said exhaust port, said lower unit also having a cavitation plate submerged in water during engine idle operation, and having a propeller with a hollow hub member having a first open end and a second open end, said first open end being in communication with said exhaust tube, said second open end defining an exhaust outlet affording discharge of the exhaust gas below said cavitation plate, said lower unit also having an outer wall including an outlet, said outer wall outlet being located above said cavitation plate and submerged in water during idle engine operation, said lower unit also having an inner wall partially defining a chamber communicating with said outer wall outlet, said inner wall being located between said outer wall and said exhaust passage, and having an end portion partially defining a lower portion of said chamber, said lower portion of said chamber being filled with water during engine operation, said inner wall end portion including a reverse relief outlet in communication with said exhaust passage and said chamber, and located so that the pressure head of the water is said lower chamber acting on said reverse relief outlet, during idle and forward engine operation, substantially prevents any portion of the exhaust gas from being discharged through said reverse relief outlet into said chamber and out said outer wall outlet, said reverse relief outlet affording, during reverse engine operation, discharge of a portion of the exhaust gas from said exhaust passage into said chamber and out said outer wall outlet above said cavitation plate and said propeller.

13. A marine propulsion device in accordance with claim 12 including a reverse locking mechanism which activates to allow said engine to tilt out of the water when said lower unit is subjected, during forward engine operation, to a substantial impact with an object, and wherein said reverse relief outlet and said outer wall outlet are sized so that reverse thrust developed by said propeller during reverse engine operation does not activate said reverse locking mechanism.

14. A marine propulsion device in accordance with claim 12 wherein said inner wall and said outer wall partially define a water jacket extending around said exhaust tube, said inner wall including an upper end which generally defines an upper limit for a water level within said water jacket, said water jacket being filled with water during engine operation, and wherein said chamber constitutes a dump water chamber which catches water overflowing from said water jacket.

* * * * *

UNITED STATES PATENT OFFICE

CERTIFICATE OF CORRECTION

Patent No. 4,036,162 Dated July 19, 1977

Inventor(s) Daniel F. Maier and John D. Sheldon

It is certified that error appears in the above-identified patent and that said Letters Patent are hereby corrected as shown below:

| | |
|---|---|
| Column 1, lines 12 and 13 | delete "propulsiondevices", insert ---propulsion devices---. |
| Column 2, line 53 | delete "passages", insert ---passage---. |
| Column 4, line 5 | delete "oulet", insert ---outlet---. |
| Column 5, line 64 | delete "or" (second occurrence), insert ---of---. |
| Column 8, line 21 | delete "is", insert ---in---. |

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*